United States Patent [19]

Milner, Jr.

[11] 4,334,710

[45] Jun. 15, 1982

[54] COLLAPSIBLE, PORTABLE DENTAL CHAIR

[76] Inventor: William E. Milner, Jr., 103 S. Elm St., Asheboro, N.C. 27203

[21] Appl. No.: 153,332

[22] Filed: May 27, 1980

Related U.S. Application Data

[63] Continuation-in-part of Ser. No. 57,509, Jul. 16, 1979.

[51] Int. Cl.[3] ..... A61G 15/00; A47C 4/00

[52] U.S. Cl. ..... 297/440; 297/377; 248/167

[58] Field of Search ..... 297/440, 445, 377; 248/167

[56] References Cited

U.S. PATENT DOCUMENTS 2,639,114 5/1953 Allen ..... 248/167
3,241,885 3/1966 Deaton ..... 297/440
3,870,366 3/1975 Rogers ..... 297/440
4,234,226 11/1980 Colby ..... 297/440

FOREIGN PATENT DOCUMENTS 228103 3/1910 Fed. Rep. of Germany ..... 297/440
2747321 4/1979 Fed. Rep. of Germany ..... 297/440

*Primary Examiner*—Francis K. Zugel
*Attorney, Agent, or Firm*—B. B. Olive

[57] ABSTRACT

A collapsible, portable dental chair is designed for transport by a dentist from one examination site to another and particularly for rural area and school use. The chair comprises a patient receiving platform and associated headrest and a base and back support frame. The chair components are releasably fitted together to provide a patient chair which can be easily dismantled and folded at one examining site for transport to another examining site or for storage.

5 Claims, 8 Drawing Figures

COLLAPSIBLE, PORTABLE DENTAL CHAIR

CROSS-REFERENCE TO RELATED COPENDING APPLICATION

This application is a continuation-in-part of copending application Ser. No. 057,509, filed July 16, 1979.

BACKGROUND OF THE INVENTION

1. Field of the Invention

This invention relates generally to tables or chairs and more particularly to a collapsible, portable dental chair for use during dental examinations.

2. Description of the Prior Art

There are numerous collapsible chairs and tables. Also, complex and expensive office dental chair constructions are well known. However, as far as applicant is aware, there is not available a dental chair which is lightweight, inexpensive, collapsible and portable and suited for use in schools and rural areas.

SUMMARY OF THE INVENTION

This invention features a collapsible, portable dental chair comprising a patient receiving platform and associated headrest, a base frame for support of the patient and platform and an adjustable back support. The parts may be separated and folded or broken down into components for transport from one area to the next or for storage.

DESCRIPTION OF THE PREFERRED EMBODIMENT

Figure 1:
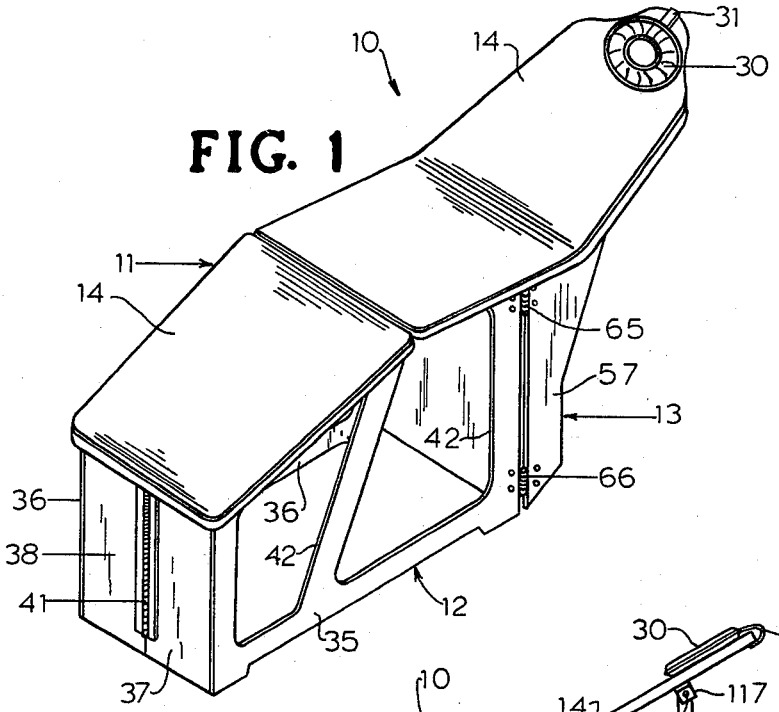
FIG. 1 is a view in perspective of a collapsible, portable dental chair made according to the invention.

Referring now to FIGS. 1–4 of the drawings, the reference character 10 generally indicates a collapsible, portable dental chair made according to the present invention. Chair 10 in a first embodiment is composed of a platform section 11, a base frame 12 and back support frame 13.

Figure 3:
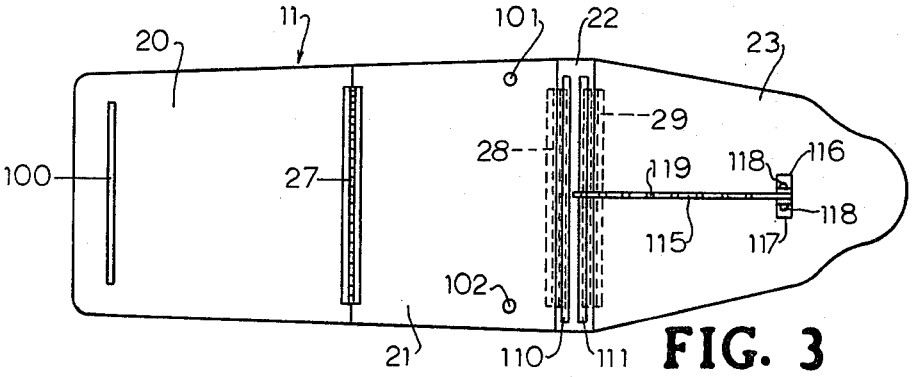
FIG. 3 is a bottom plan view of the platform portion of the dental chair with the platform covering removed for clarity of illustration.

FIG. 3 is illustrative of platform section 11 with the outer pad covering 14 being removed for clarity. Platform section 11 includes, in addition to the covering 14, leg section 20, seat portion 21, bend section 22 and back section 23, each being in the nature of a panel having covering 14 and shaped in the form illustrated. Piano hinge 27 mounted on the bottom side of platform section 11 pivotally connects leg section 20 with seat section 21. Another piano hinge 28 is mounted on the top side of platform section 11 and connects seat section 21 and bend section 22. A further piano hinge 29 is mounted on the top side of platform section 11 and connects back section 23 with bend section 22. Once the individual sections have been hinged together and covered to produce the assembled platform section 11, it can be seen that for storage or transport purposes, leg section 20 may be folded back against seat section 21 with the respective inside bottom surfaces thereof abutting and bend section 22 can pivot on seat section 21 and allow back section 23 to pivot on bend section 22 so that the inside bottom surface of seat section 21 can rest on the top surface of the folded seat section 21. A head pillow 30 is integrally secured by means of strap 31 to the outer edge of back section 23 and allows for the patient to recline on platform section 11 with the patient's head resting on pillow 30.

Base frame 12 is composed of side panels 35, 36 and end panels 37, 38. End panel 37 is pivotally secured to side panel 35 by piano hinge 39 and end panel 38 is pivotally secured to side panel 36 by piano hinge 40. End panels 37, 38 are pivotally connected together by the externally mounted piano hinge 41 and pivot inwardly so that end panels 37, 38 for purpose of storage or transport may fold back against the inside walls of side panels 35, 36. Openings 42 are formed in side panels 35, 36 and serve to lighten the overall weight of chair 10 for ease in transport. Piano hinge 41 prevents outward folding of panels 37, 38.

A pair of male bed frame type brackets 43, 44 are mounted on the inside free end of side panel 36 and a similar pair of male, bed frame brackets 45, 46 are mounted on the inside free end of side panel 35 and the hooks 47–50 thereof protrude outwardly and downwardly with the function of such hooks being later described.

Figure 5:
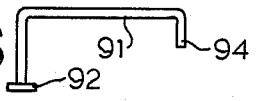
FIG. 5 is a side view of a support rod used with the invention.

Back support 13 is composed of a rectangular back panel 55 and generally triangular-shaped side panels 56, 57. A pair of hinges 58, 59 equipped with removable pins are used to pivotally connect back panel 55 with side panel 56. Removal of pins **58*a*, 59*a* allows for separation of panels 55 and 56. Another pair of hinges 65, 66, which are also equipped with removable pins, are used to pivotally connect back panel 55 with side panel 57. Removal of pins 65*a*, 66*a* allows for separation of panels 55 and 57. A further hinge 70 equipped with a removable pin pivotally connects side panels 56, 57. Removal of pin 70*a* allows for separation of panels 56, 57. Female-type bed frame brackets 73, 74 are mounted on one outside vertical edge of back panel 55 and are positioned to align with male bed frame brackets 43, 44. Slots 75 of bracket 73 receive hooks 47 and slots 76 receive hooks 48. A similar pair of female bed brackets 80, 81 are mounted on the opposite outside vertical edge of back panel 55 and are positioned to align with male bed frame brackets 45, 46. Slots 82 of bracket 80 receive hooks 49 of bracket 45 and slots 83 of bracket 81 receive hooks 50 of bracket 46. Once these hooks and slots are engaged, base frame 12 and back support 13 are integrally connected until the hooks are removed from the slots. A bracket 90 pivotally receives a rod 91, shaped as illustrated in FIG. 5, which is vertically movable within bracket 90. Flange 92 on the lower end of rod 91 prevents such rod from being withdrawn from bracket 90. Another bracket 93, similar to bracket 90, receives the downwardly bent end 94 of rod 91 and retains it within bracket 93 until rod 91 is raised and end 94 is pivoted away from bracket 93**.

Once panels 55–57 are assembled together to form back support 13 and back support 13 and base frame 12 are secured together, as previously described, platform section 11 is positioned on top of base frame 12. Positioning bar 100, on the bottom side of platform leg section 20, is designed to reside behind end panels 37, 38 and between side panels 35, 36. Positioning bar 100 thus acts to prevent inward folding of panels 37, 38 on hinge 41 and also acts to stiffen and prevent lateral movement between side panels 35, 36. Recessed holes 101, 101', 102, 102' on the bottom of the platform seat section 21 are located so that they may be aligned with pins 103, 103', 104, 104' which are integrally secured to the top edges of side panels 35, 36. Once pins 103, 103', 104, 104' are received by holes 101, 101', 102, 102', seat section 21 is further prevented from lateral movement between side panels 35, 36 and, in conjunction with the effect of positioning bar 100, is maintained in a relatively fixed position with respect to base frame 12.

Figure 2:
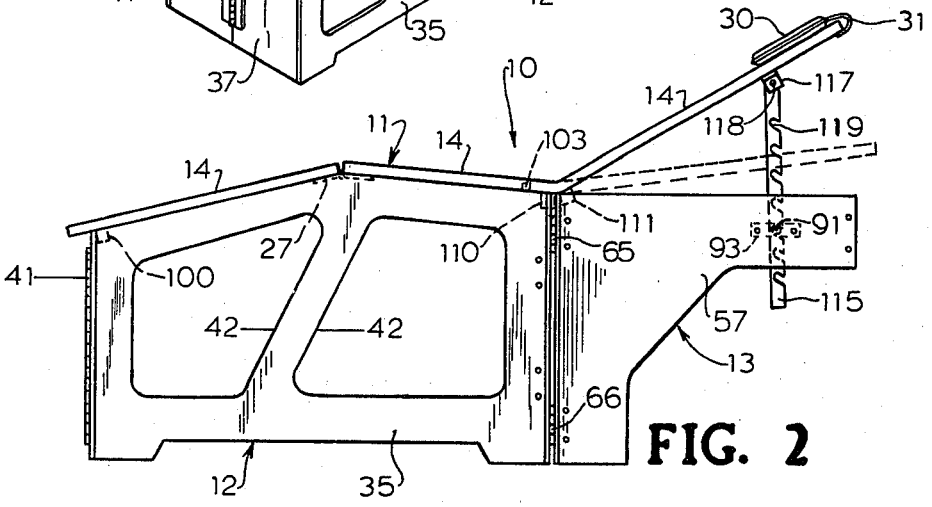
FIG. 2 is a side elevation view thereof with the backrest illustrated in two positions.

Positioning bars 110, 111 are integrally secured on the bottom side of the platform bend section 22, illustrated in FIG. 3, and are located to receive the top edge of back panel 55 therebetween, as illustrated in FIG. 2. Positioning bars 110, 111, once located on back panel 55 as described, serve to prevent both lateral and longitudinal movement of platform section 11 on base frame 12 and back support frame 13.

Figure 4:
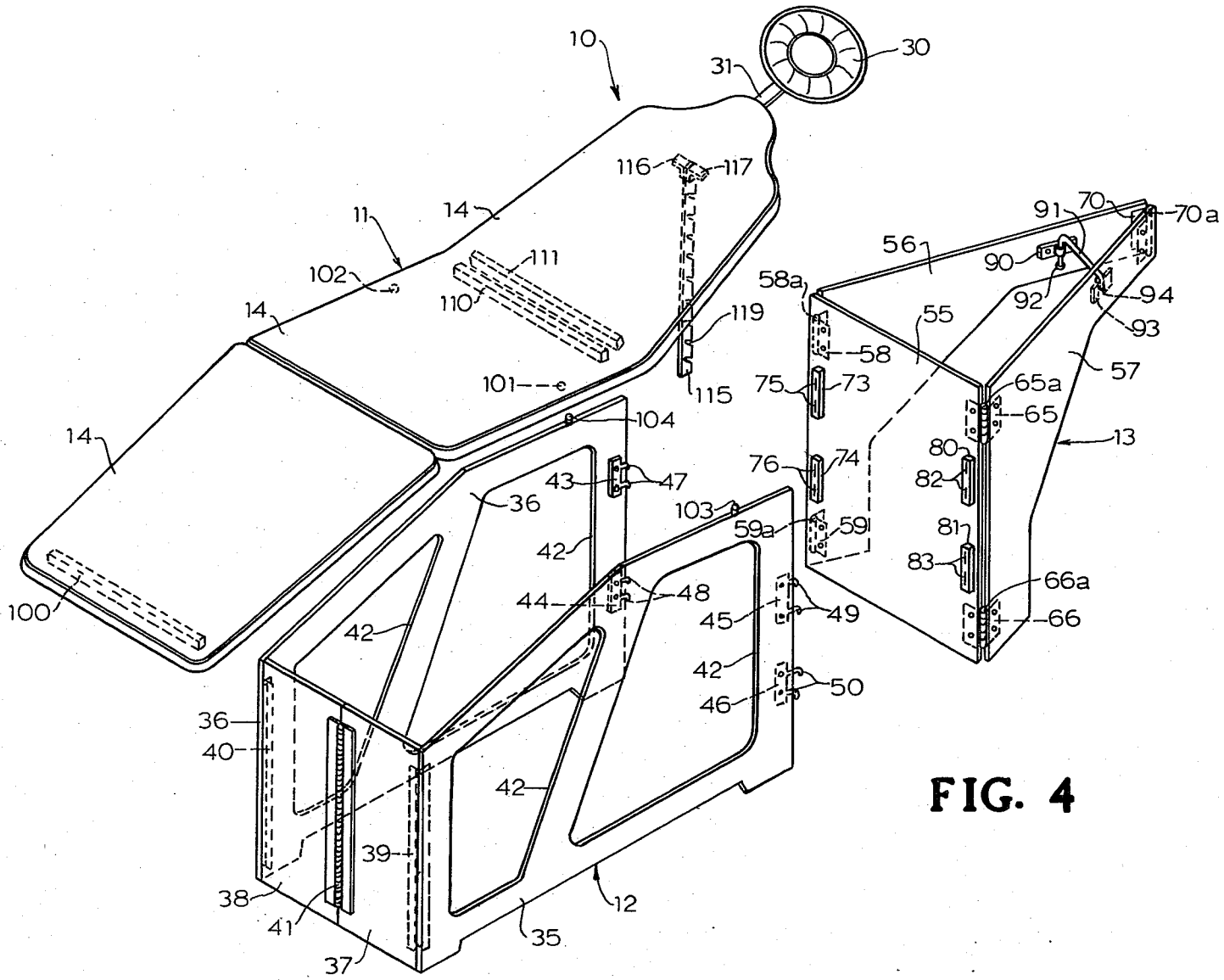
FIG. 4 is an exploded, perspective view of the components comprising the chair of the invention.

Back section 23 pivots about hinge 29, as seen in FIG. 3, and is adjustable for height by means of back support bar 115 working in conjunction with rod 91. Support bar 115 is pivotally suspended from back section 23, as seen in FIGS. 2–4. A pair of angle brackets 116, 117 are secured to the bottom surface of back section 23 and serve to mount a pin 118 which in turn pivotally supports one end of the support bar 115. A plurality of slots 119 formed in bar 115 engage rod 91 in use so as to provide variable positioning and support for back section 23. Either of slots 119 may be utilized depending upon the posture desired for the patient during the particular dental examination.

As best seen in FIG. 2, side panels 35, 36 have top support edges converging at an oblique angle for the comfort of the patient. This arrangement causes leg section 20 to assume a slight downward angle once placed on side panels 35, 36 with leg section 20 being allowed to pivot on hinge 27. Seat section 21 in use is also angled slightly but in the opposite direction. Back section 23, as viewed in top plan, is tapered inwardly from hinge 29 to generally conform to the shape of the shoulders and head of an average person. As previously stated, leg section 20, seat section 21, bend section 22, back section 23 and head pillow 30 are all covered with a suitable covering which, for example, may be a padded vinyl material for the patient's comfort.

For ease of storage or transport, platform section 11 may be removed and folded about hinges 27–29 and head pillow 30 folded therein. Base frame 12 and back support 13 are disengaged by disconnecting male brackets 43–46 from female brackets 73–74 and 80–81. Base frame 12 may then be folded about hinges 39–41. Back support frame 13 may be broken down and folded by disengaging rod end 94 from bracket 93, removing hinge pin 70*a* and folding the pieces. Back support frame 13 may be further broken down by removing hinge pins 58*a*, 59*a*, 65*a* and 66*a*.

Figure 8:
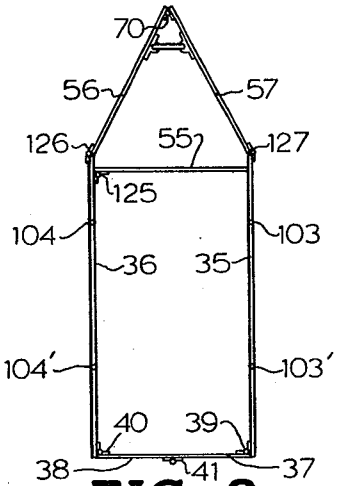
FIG. 8 is a plan view of the alternate base and back support frame in operative position.
Figure 7:
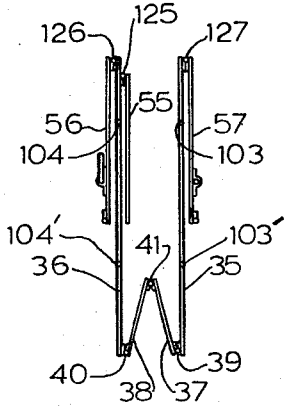
FIG. 7 is a plan view showing how the alternate base and back support frame folds for transport.
Figure 6:
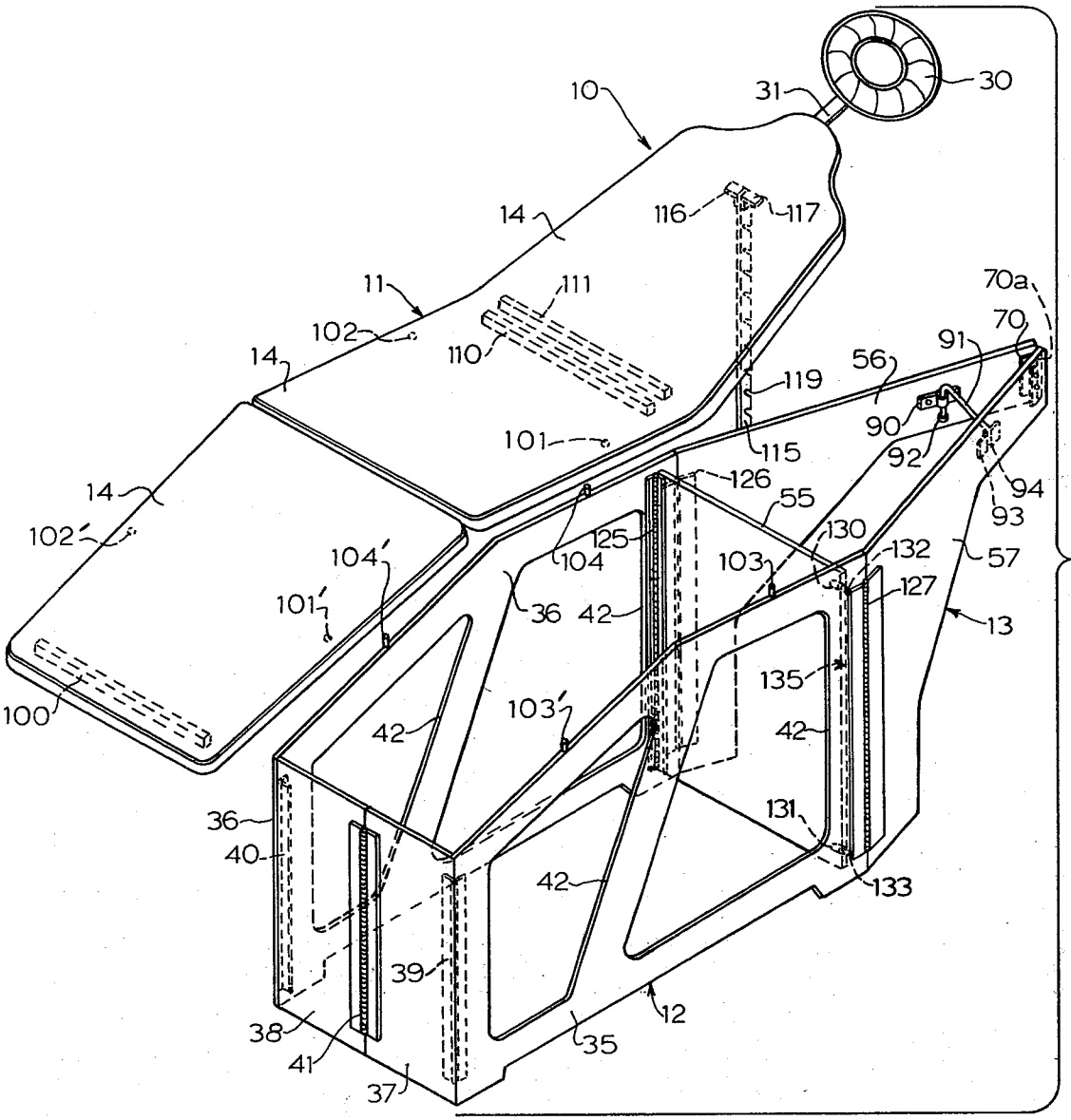
FIG. 6 is a perspective view of an alternate base and back support frame.

In an alternative embodiment, illustrated in FIGS. 6–8, the base support frame and back support frame are hinged and interconnected in a manner enabling all of the component panels to remain connected when folded for transport. Since the same component panels are employed in both embodiments, the same numeral designations are used except as to those components which differ in the manner of hinging and interconnecting the panels. It should also be noted that the previously-described plaform section 11 is used with both embodiments with no alteration. Therefore, no further detailed description of platform section 11 will be given.

In the second embodiment, end panels 37–38 are hinged together and are also hinged to side panels 35–36 in the same manner as previously described. Such similarity can be seen by comparing FIGS. 4 and 6. The inner panel 55, according to the second embodiment, is hinged to side panel 36 by means of a piano hinge 125 which thus allows panels 55 and 36 to remain pivotally connected both during use and during transport. Likewise, back panel 56 is hinged to side panel 36 by means of a piano hinge 126. Thus, back panel 56 and side panel 36 also remain pivotally connected together, both during use and during transport. With further reference to the second embodiment, it will also be noted that back panel 57 is also hinged to side panel 35 by means of a piano hinge 127. Thus, back panel 57 and side panel 35 also remain pivotally connected during use as well as during transport.

From the foregoing description and as illustrated by FIGS. 6–8, the panels, i.e., panels 35–38, 55 and 56–57 comprising the base support and back support frame of the portable dental chair according to the second embodiment are adapted to fold in what is essentially a single interconnected structure and which can be transported as a flat assembly as illustrated in FIG. 7.

When platform 11 is being supported, the inner panel 55 is secured between the side panels 35, 36 by means of a pair of male hinge pins 130, 131 mounted on an outer vertical edge of panel 55 and which are adapted to be received by female sockets 132, 133 mounted on an interior forward vertical edge portion 135 of panel 35. Thus, by fitting pins 130, 131 into sockets 132, 133, panel 55 can be maintained in a secured relation for supporting platform 11 or can be quickly released for folding into a transportable assembly as illustrated in FIG. 7.

While a wide choice of materials are available, wood paneling and metal hardware have been employed for the described panel and hardware items comprising the chair of the invention. With this type of construction, there has been achieved a dental chair meeting all of the objectives of being collapsible, portable, lightweight and relatively inexpensive, all of which characteristics are highly desirable with increasing health care cost and the need to accommodate dental needs in schools and rural areas where the chair of the invention finds it best application.

While the chair of the invention has been described primarily in connection with dental practice, it is recognized that the described chair construction may also find use in other applications such as for general medical practice, particularly in remote areas, psychiatric practice and in some cases as a useful piece of furniture. Particularly for dental practice, it will be noted that the triangular-shaped panels making up the back support frame in the form illustrated allow the dentist to stand near the patient with his feet protruding beneath the panels making up such frame. Thus, for any application requiring patient care on the head area, the invention chair offers a unique advantage.

What is claimed is:

1. A collapsible, portable and lightweight chair particularly adapted for use in dental examinations, comprising:

(a) a base frame unit comprising:

(i) a pair of uniform size vertical side panels having vertical outer and inner end edges, bottom support edge surfaces and top edges converging inwardly from the end edges at an upwardly directed obtuse angle;

(ii) a pair of uniform size outer vertical rectangular end panels hinged together along their respective inner vertical edges and in a manner permitting inward folding thereof, said end panels being equal in height to the length of said side panel outer vertical end edges and each end panel having a hinge connection on its respective outer vertical edge to a respective outer end edge of a said side panel so as to establish a generally U-shaped base frame unit with said pair of end panels serving to join said side panels and being hinged thereto in a manner permitting inward folding of said end panels between said side panels for transport, the bottom edges of said end panels providing bottom support surfaces and the top edges of said end panels being horizontally aligned with the tops of said side panel outer end edges;

(b) a back support frame, comprising:

(i) a pair of uniform size vertical back panel members converging outwardly and having opposed elevated vertical outer edges secured together with manually removable fastener means, inwardly located bottom support edge surfaces, vertical inner end edges, horizontal top edges, and other edges defining a cut out portion below said top edges and outwardly from panel portions bounded by said top edges and end edges to provide free standing room under outer portions of said back support frame;

(ii) an inner rectangular panel member joined with detachable fastening means along its outer vertical edges to respective inner vertical edges of said vertical back panel members and additionally joined by detachable fastening means along its said outer vertical edges to the inner vertical end edges of said side panels, said inner panel member having a bottom support edge surface and a top edge surface coinciding with the top edges of said back panel members; and (c) a platform member detachably mounted on said base frame and comprising a substantially rectangular-shaped leg section, a seat section hinged to said leg section along an inner transverse edge thereof, a rectangular bend section having a width equal to the width of said seat section and having a substantially short length as compared to the length of said leg and seat sections, said bend section being hinged transversely along one end thereof to the end of said seat section, and a back section hinged to an opposite end of said bend section and having an inwardly tapered shape as viewed in plan; and (d) adjustable support means on said back support frame for said head section.

2. A chair as claimed in claim 1 wherein said adjustable support means comprise a support lever pivotally secured on one end to and below said head section and having a free end portion with a plurality of notch formations formed along the length thereof, and a horizontal rod member supported between said back panel members and engagable by a selected notch on said lever member to provide adjustable support means for said head section.

3. A chair as claimed in claim 2 wherein said horizontal rod member includes support means from which it is disengagable during transport of said chair.

4. A collapsible, portable and lightweight chair particularly adapted for use in dental examinations, comprising:

(a) a base frame unit comprising:

(i) a pair of uniform size vertical side panels having vertical outer and inner end edges, bottom support edge surfaces and top edges converging inwardly from the end edges at an upwardly directed obtuse angle;

(ii) a pair of uniform size outer vertical rectangular end panels hinged together along their respective inner vertical edges and in a manner permitting inward folding thereof, said end panels being equal in height to the length of said side panel outer vertical end edges and each end panel having a hinge connection on its respective outer vertical edge to a respective outer end edge of a said side panel so as to establish a generally U-shaped base frame unit with said pair of end panels serving to join said side panels and being hinged thereto in a manner permitting inward folding of said end panels between said side panels for transport, the bottom edges of said end panels providing bottom support surfaces and the top edges of said end panels being horizontally aligned with the tops of said side panel outer end edges;

(b) a back support frame, comprising:

(i) a pair of uniform size vertical back panel members converging outwardly and having opposed elevated vertical outer edges secured together with manually removable fastener means, inwardly located bottom support edge surfaces, vertical inner end edges, horizontal top edges, and other edges defining a cut out portion below said top edges and outwardly from panel portions bounded by said top edges and end edges to provide free standing room under outer portions of said back support frame;

(ii) an inner rectangular panel member having outer vertical edges, a bottom support edge surface and a top edge surface coinciding with the top edges of said back panel members; and (iii) fastening means for interconnecting said side, back and inner panel members with the respective inner vertical end edges of said side and back panel members being joined together and with the said outer vertical edges of said inner panel member residing between and having the outer vertical edges thereof joined to said side panels proximate the inner end edges thereof, selected said fastening means being manually detachable and being adapted to permit said panels to be assembled in a flat stacked assembly for transport; and (c) a platform member detachably mounted on said base frame and comprising a substantially rectangular-shaped leg section, a seat section hinged to said leg section along an inner transverse edge thereof, a rectangular bend section having a width equal to the width of said seat section and having a substantially short length as compared to the length of said leg and seat sections, said bend section being hinged transversely along one end thereof to the end of said seat section, and a back section hinged to an opposite end of said bend section and having an inwardly tapered shape as viewed in plan; and (d) adjustable support means on said back support frame for said head section.

5. A chair as claimed in claim 4 wherein said fastening means includes a first set of hinges interconnecting the respective inner vertical end edges of said side and back panel members, a second hinge interconnecting one said outer vertical edge of said inner panel member to one of said side panel members proximate an inner vertical edge thereof and second manually removable fastening means for releasably joining the other said outer vertical edge of said inner panel member to the other said side panel member proximate the other inner vertical edge thereof.

* * * * *